US005418097A

United States Patent [19]

Furuya et al.

[11] Patent Number: 5,418,097

[45] Date of Patent: May 23, 1995

[54] COLOR IMAGE RECORDING METHOD AND APPARATUS

[75] Inventors: Nobumasa Furuya; Tsuneo Noami; Takeshi Sumikawa, all of Kanagawa, Japan

[73] Assignee: Fuji Xerox Co., Ltd., Tokyo, Japan

[21] Appl. No.: 43,764

[22] Filed: Apr. 6, 1993

[30] Foreign Application Priority Data

Apr. 7, 1992 [JP] Japan ..... 4-113152
Dec. 28, 1992 [JP] Japan ..... 4-358687

[51] Int. Cl.[6] ..... G03G 13/01

[52] U.S. Cl. ..... 430/42; 430/45; 118/645

[58] Field of Search ..... 355/246, 326; 118/645; 430/45, 42

[56] References Cited

U.S. PATENT DOCUMENTS 5,030,996 7/1991 Tajima et al. ..... 355/246
5,270,138 12/1993 Kaneko et al. ..... 430/45

FOREIGN PATENT DOCUMENTS 55-36889A 3/1980 Japan .
57-7970A 5/1982 Japan .
60-126665A 7/1985 Japan .
60-176069A 9/1985 Japan .
2-4903B2 1/1990 Japan .
2-77767A 3/1990 Japan .

*Primary Examiner*—John Goodrow

*Attorney, Agent, or Firm*—Finnegan, Henderson, Farabow, Garrett & Dunner

[57] ABSTRACT

A color image recording apparatus according to the present invention comprises a light-sensitive drum, a first developing device for developing a first electrostatic latent image on the drum surface as a first toner image, a second developing device for developing a second electrostatic latent image as a second toner image on the drum surface along with the first toner image, and a developing bias voltage source for applying a developing bias voltage to the second developer device comprising a DC component and an AC component of a predetermined period, wherein the AC component has a waveform such that the time for the voltage to change from a value such that an electric field making toner move toward the electrostatic latent image is maximum to a value such that the electric field becomes minimum is set to be at least ½ of the predetermined period of the AC component. According to a method of the present invention a first toner is electrostatically attracted to an electrostatic latent image on the surface of a light-sensitive drum, and then a second toner is electrostatically attracted to the electrostatic latent image on the drum surface by applying a periodic AC electric field in which the time during which the electric field develops the electrostatic latent image with the second toner exceeds the time during which the electric field does not develop the electrostatic latent image with the second toner. The developed first and second toner images are then simultaneously transfered to a copy sheet.

8 Claims, 10 Drawing Sheets

COLOR IMAGE RECORDING METHOD AND APPARATUS

BACKGROUND OF THE INVENTION

1. Field of the Invention

The present invention relates to a color image recording method and apparatus which form a plurality of color images on a electrostatic latent image formation member such as a light-sensitive member by the use of an electrophotographic recording method and then transfer the plurality of color images to a recording medium together, and relates in particular to a color image recording method and apparatus providing color images of improved quality.

2. Discussion of the Related Art

Conventionally many different color image recording methods adopting an electrophotographic recording method are known. An example of these methods is what is called a superimposing development method, which successively superimposes plural images of different colors on a electrostatic latent image formation member such as a light-sensitive member to form a plurality of images of different colors on it. The plurality of color images is transferred together to a recording medium, resulting in a color image. This method requires only one electrostatic latent image formation member such as a light-sensitive drum, and additionally does not need a transfer drum; therefore the recording apparatus can be miniaturized, and moreover image formation is exceedingly speedy because the plurality of color images can be formed during a single rotation of the electrostatic latent image formation member.

However, the superimposing developing method described above has the problem that the toner image deteriorates to a high degree during the developing process for the second and subsequent colors because the previously developed toner image is damaged as it passes through the developing area again, thus leading to a final color image with severe deterioration. Another problem occurs in the second developing process that part of the toner is rubbed off the toner image formed on the electrostatic latent image formation member in the first developing process and then contaminates the second developer, which causes a reduction of the first toner image density and extreme reduction in the life of the second developer.

To overcome the above-mentioned problems in the superimposing developing method, that is, to develop the second and subsequent latent images without damaging the toner image previously formed on the electrostatic latent image formation member, many techniques have been proposed in relation to the electrostatic latent image formation method or the developing method for the second and subsequent images.

Japanese Patent Application Unexamined Publication No. Sho. 55-36889 (1980) discloses a two-color image reproduction method successively developing two electrostatic latent images formed on the surface of an electrostatic latent image formation member by a pair of magnetic brush developing devices using developers of different colors wherein the second magnetic brush developing device is constructed so that its friction contact force is less than that of the first magnetic brush developing device.

In Japanese Patent Application Unexamined Publication No. Sho. 57-79970 (1982), a two-color developing apparatus for electrophotography having first and second developing devices, forms two electrostatic latent images of opposite polarities on an electrostatic latent image formation member, and develops them with two different two-component toners of different colors. The first and second developing apparatuses have main magnets of different magnetic power, and additionally the main magnets are constructed so that their shape and the distributions of their magnetic flux are different.

The color image recording apparatus disclosed by Japanese Patent Application Unexamined Publication No. Sho. 60-126665 (1985) repeats the process of forming an electrostatic latent image on an electrostatic latent image formation member in a latent image forming section and developing the electrostatic latent image in a developing section a number of times, and then transfers the visible image to a recording medium. Among the plurality of the developing sections described above, at least the second and subsequent developing sections employ a two-component developer made by mixing a non-magnetic toner and a magnetic carrier having a particle diameter of 50 μm or less.

The electrophotographic recording apparatus disclosed by Japanese Patent Application Examined Publication No. Hei. 2-4903 (1990) comprises a means for forming a first latent charge image on a light-sensitive drum member, a first developing means for developing the first latent charge image formed by the means for forming the first latent charge image on the light-sensitive drum member by using a magnetic developer having charged toner of a first color, a means for forming a second latent charge image on the light-sensitive drum member after development by the first developing means, a second developing means for developing the second latent charge image formed by the means for forming the second latent charge image on the light-sensitive drum member by using a magnetic developer having charged toner of a second color, wherein the second developing means comprises a fixed magnet roller whose portion facing the light-sensitive drum member is between two like magnetic poles, a rotating sleeve for carrying developer rotatably installed around the periphery of the fixed magnet roller, a means for applying a DC bias potential having the same polarity as the latent charge image formed on the light-sensitive drum member between the rotating sleeve for carrying developer and the light-sensitive drum member, and a means for applying an AC bias potential to the magnetic developer, which is attached to the surface of the rotating carrying sleeve and carried thereby on the portion facing the light-sensitive drum member, and wherein the spacing between the surface of the magnetic toner attached to the surface of the rotating carrying sleeve and the surface of the light-sensitive drum member facing the magnetic developer is maintained to be 0.05–0.5 mm.

Japanese Patent Application Unexamined Publication No. Hei. 2-77767 discloses a multi-color electrostatic recording apparatus having an electrostatic latent image formation member on which an electrostatic latent image is formed, a developer holding member for holding developer and rotating in a predetermined direction and performing at least two cycles of developing processes by applying a predetermined developing bias voltage to the developer holding member for attaching developer held by the developer holding member to the electrostatic latent image formed on the electrostatic latent image formation member to develop it, wherein ½ of the maximum voltage in one waveform cycle of the developing bias voltage applied to the developer holding member is set to be different from the average voltage in one waveform cycle of the developing bias voltage in the second and subsequent developing processes.

However, the conventional art described above has some problems. The inventions disclosed by Japanese Patent Application Unexamined Publications Nos. Sho. 55-36889 (1980), Sho. 57-79970 (1982), and Sho. 60-126665 (1985) are magnetic brush developing methods with a low friction contact force; the developing efficiency or developing capability is lowered in the second developing process, and therefore a sufficient image density cannot be obtained for the second and subsequent colors.

The non-contact developing method disclosed by Japanese Patent Application Examined Publication No. Hei. 2-903 is constructed to maintain the spacing of 0.05–0.5 mm between the surface of the magnetic developer attached to the peripheral surface of the rotating carrying sleeve for the magnetic developer and the surface of the light-sensitive drum member facing the magnetic developer. For this reason, it is difficult to make the pile height of the magnetic brush uniform to a tolerance of 50 μm or less when the spacing is set to be minimum, and besides the low pile density causes a reduction of developing efficiency, thus resulting in insufficient and excessively uneven image density.

Another non-contact developing method in Japanese Patent Application Unexamined Publication No. Hei. 2-77767 (1990) provides an alternating electric field, and by arranging that one half of the peak voltage in a cycle of the bias waveform is different from the average voltage, makes it easier to transfer the developer to the electrostatic latent image formation member, and thus improves development efficiency. In this method, although the developing efficiency is improved, the second toner adheres to the first image area, (referred to as color mixing,) because an electric field strong enough to develop an image is also present in the first image area which has been already developed. Moreover, in the case where the first and second toner are charged with different polarities, an electric field in the direction effective to develop the image with the second toner removes the first toner from the surface of the electrostatic latent image formation member, which aggravates the reduction of the density of the first toner image and deterioration of the second developer because it is contaminated by the first toner.

Further, as one of the other methods related to a non-contact developing method, the developing apparatus disclosed by Japanese Patent Application Unexamined Publication No. Sho. 60-176069 (1985) is also known though it is not necessarily employed for a color image recording method. This invention is characterized in that a horizontal magnetic field is applied to the developer in a developing area, developer is held on a developer holding member without contacting an electrostatic latent image formation member and that an oscillating electric field is used for development. This method requires a strong oscillating electric field to obtain sufficient developing density, and accordingly, if the method is adopted for the superimposing developing method, the problem occurs that first toner image is removed by the effect of the oscillating electric field, thus leading to reduction of density of the first toner image and contamination of the second developer with the first toner.

SUMMARY OF THE INVENTION

The present invention has been made in view of the above circumstances and has as an object to overcome the above-mentioned problems.

A further object of the present invention is to provide a color image recording method and apparatus preventing deterioration of image quality and image density of a first image.

Another object of the present invention is to provide a color image recording method and apparatus avoiding color mixing and contamination of a second developing device by a first toner.

Another object of the present invention is to provide a color image recording method and apparatus generating an image with sufficient image density in development for the second and subsequent colors.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the object and in accordance with the purpose of the invention, as embodied and broadly described herein, a color image recording apparatus of this invention comprises an electrostatic latent image formation member, a first toner image forming means for forming a first toner image electrostatically on the electrostatic latent image formation member, a second toner image forming means for forming a second toner image electrostatically on the electrostatic latent image formation member on which the first toner image has been previously formed, and a developing bias voltage applying means for applying a developing bias voltage to the second toner image forming means, wherein the developing bias voltage consists of a DC component and an AC component of a predetermined period and the AC component has a waveform such that the time for the voltage to change from a value such that an electric field making toner move toward the electrostatic latent image is maximum to a value such that the electric field becomes minimum is set to be at least ½ of the predetermined period of the AC component.

A color image recording method of this invention comprises the steps of attaching a first toner electrostatically to an electrostatic latent image formation member, attaching a second toner electrostatically to the electrostatic latent image formation member by applying a periodic AC electric field in which the time in which the electric field develops an electrostatic latent image with toner exceeds the time in which the electric field does not develop the electrostatic latent image with toner, and transferring the first and second toner held on the electrostatic latent image formation member simultaneously to a recording medium.

In the color image recording method according to the present invention, the AC developing bias voltage for the second and subsequent developing processes is determined such that the time from a maximum voltage of the electric field developing an electrostatic latent image on an electrostatic latent image formation member with toner to a minimum voltage of the electric field developing the electrostatic latent image on an electrostatic latent image formation member with toner is at least ½ of one period of the AC component; therefore the time for the acceleration of the toner being transferred to the electrostatic latent image formation member to develop the electrostatic latent image change from maximum to minimum is increased. As a result, toner developing the electrostatic latent image can be easily transferred to the electrostatic latent image formation member, which improves developing efficiency in the second and subsequent developing processes and provides a sufficient developing density even though the AC component of the developing bias voltage is small. Since the waveform of the developing bias voltage is selected such that an average of the maximum and minimum voltage in one cycle is equal to the average voltage value for one cycle, the AC voltage can be set to be low to the degree not to affect or remove toner already attached to the electrostatic latent image formation member, thus avoiding disturbance of the first toner image, reduction of the image density or shortening of the life of the second developer.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

Preferred embodiments of a color image recording apparatus according to the present invention will be described in detail based on the drawings.

First Embodiment

Figure 1:
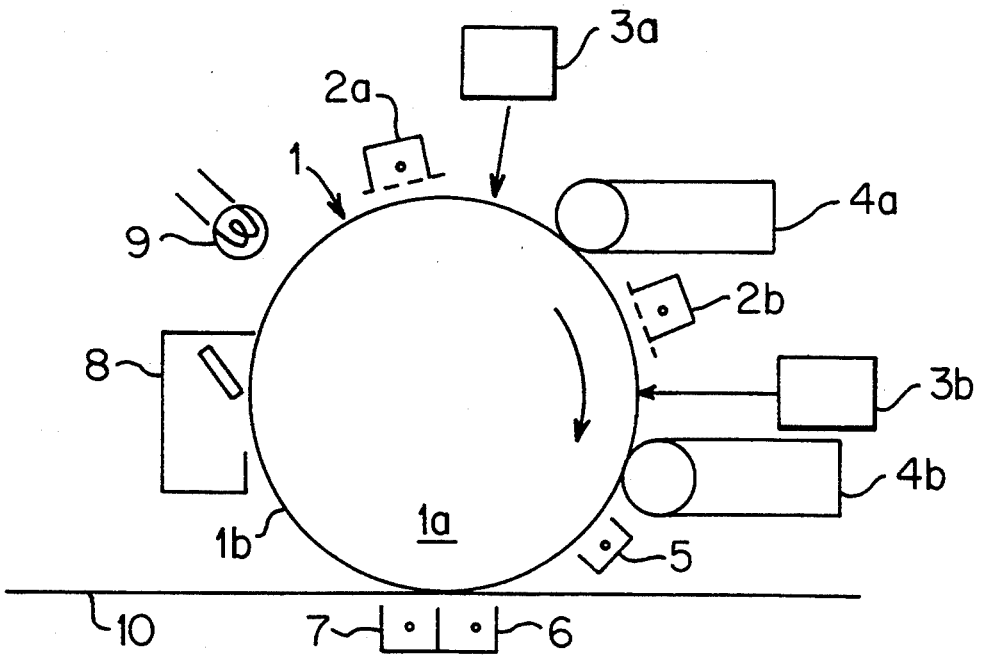
FIG. 1 shows the construction of an embodiment of a color image recording apparatus according to the present invention.

FIG. 1 shows the construction of a first embodiment of a color image recording apparatus employing a color image recording method according to the present invention.

In the figure, 1 is a light-sensitive drum employed as an electrostatic latent image formation member, which is made by forming a thin light-sensitive layer 1*b* on a cylindrical member 1*a* of conductive material. As the light-sensitive layer 1*b*, may be used, for example, a negatively charged organic light-sensitive member, referred to as OPC. The outside diameter of the light-sensitive drum 1 is 100 mm and its surface linear speed, in other words the process speed is 160 mm/s for instance.

Around the light-sensitive drum 1, are installed in order in the direction of rotation of the light-sensitive drum 1 a first electrical charger 2*a*, a first exposing means 3*a*, a first developing device 4*a*, a second electrical charger 2*b*, a second exposing means 3*b*, a second developing device 4*b*, a pre-transfer corotron 5, a transfer corotron 6, a separating corotron 7, a cleaner 8 and an erase lamp 9.

Any exposing means capable of providing exposure corresponding to image information, such as a laser writing device, an LED array or a liquid crystal light valve consisting of a uniform light source and a liquid crystal shutter may be adopted as the first exposing means 3*a* and the second exposing means 3*b* described above according to the purpose. These first exposing means 3*a* and second exposing means 3*b* may serve for either image portion exposure or background exposure, selected as the need demands.

The first developing device 4*a* uses a magnetic brush developing method and uses for example, a two-component developer comprising red toner and ferrite particle carrier having an average particle diameter of 100 μm. On the other hand, the second developing device 4*b* adopts a non-contact developing method and uses for example, a two-component developer comprising black toner and carrier made by mixing magnetic particles such as magnetite into a synthetic resin having average particle diameter of 40 μm.

Figure 2:
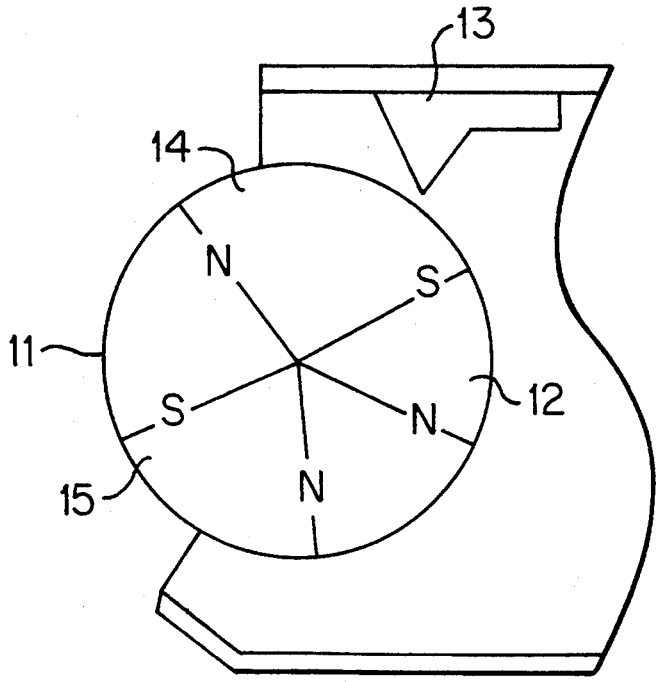
FIG. 2 shows the essential construction of a developing device used in a color image recording apparatus according to the present invention.

The developing device used in this embodiment is illustrated with FIG. 2.

The second developing device 4*b* comprises a rotatable non-magnetic cylindrical sleeve 11 as a developer holding member and a magnetic roller 12 arranged inside the sleeve 11. The magnetic roller 12 is fixed so that an approximate midpoint between magnetic poles 14 and 15 faces the light-sensitive drum 1. The thickness of developer attached to the non-magnetic cylindrical sleeve 11 for transfer is maintained constant by a thickness regulating member 13, and then developer is carried to a developing area facing the light-sensitive drum 1 by rotation of the non-magnetic cylindrical sleeve 11. In this embodiment, the spacing between the light-sensitive drum 1 and the non-magnetic cylindrical sleeve 11 is set to be 500 μm, and the thickness of the developer in the portion facing the light-sensitive drum is set to be 350 μm. The outside diameter of the non-magnetic cylindrical sleeve 11 is 25 mm. The magnetic pole 14 is at 70° to the magnetic pole 15.

A predetermined developing bias voltage, which comprises an AC voltage superimposed on a DC voltage, is applied to the non-magnetic cylindrical sleeve 11 by a developing bias voltage power supply 20, as will be described later. The DC component of the developing bias voltage is set to be, for example, −500 V to prevent fogging and color mixing into the first image.

Figure 3A:
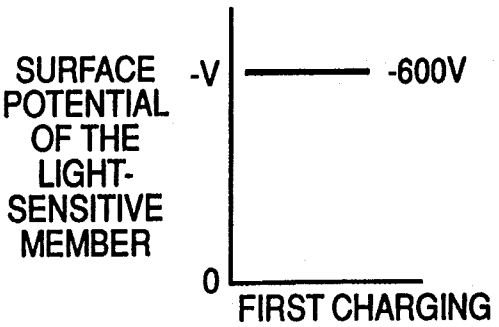
FIGS. 3(*a*)–(*f*) illustrate potentials in the image formation process.
Figure 3B:
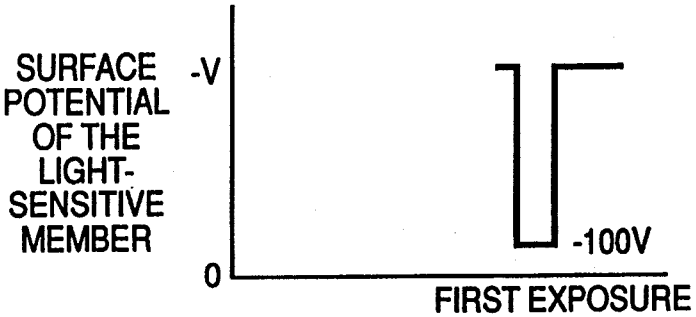
Figure 3C:
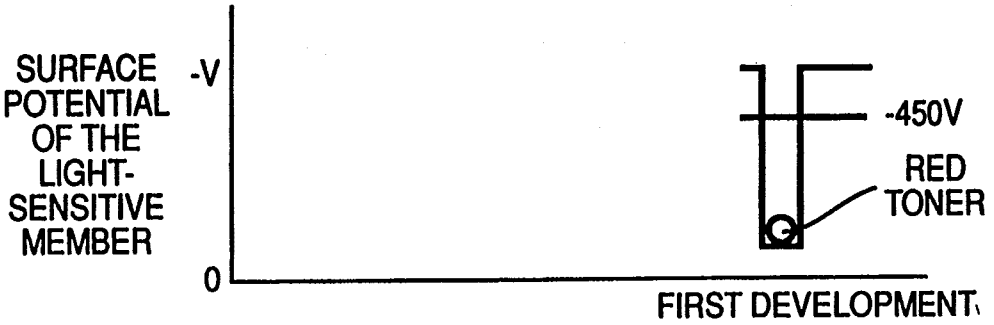
Figure 3D:
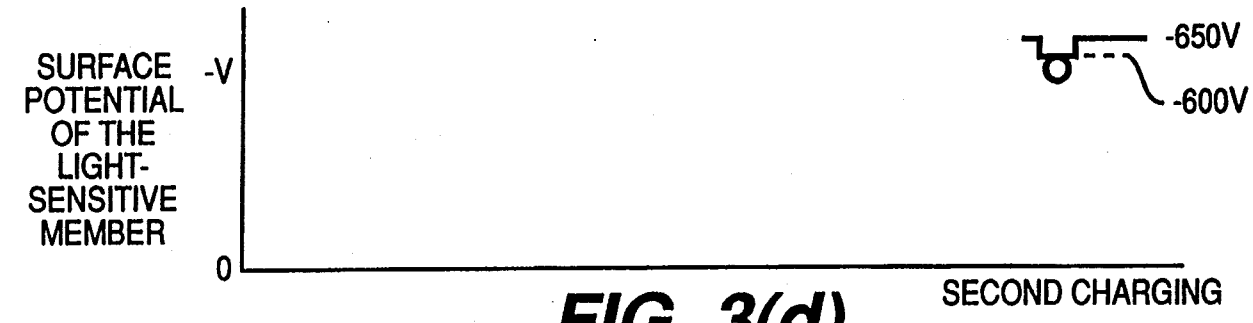
Figure 3E:
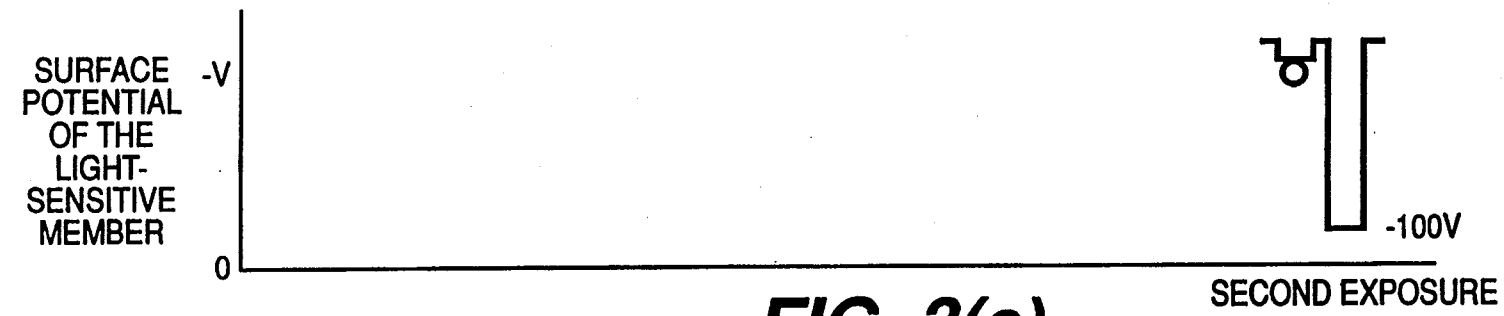
Figure 3F:
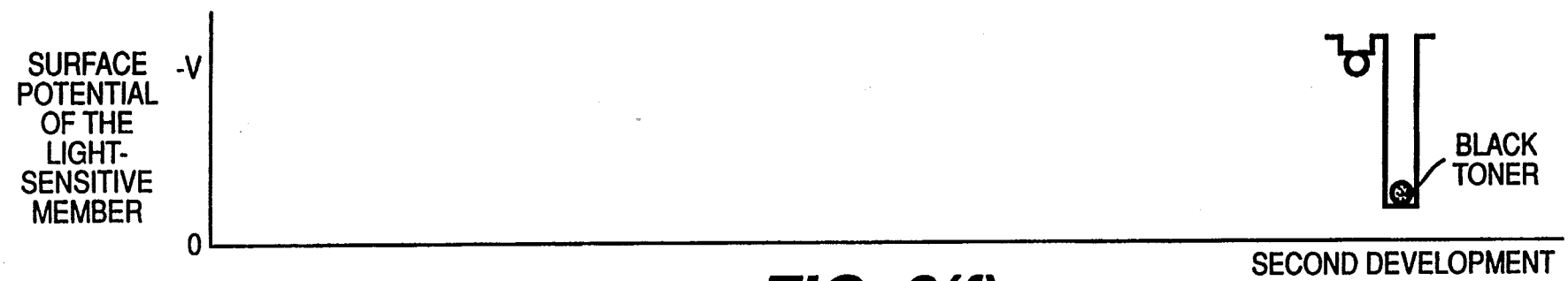

The light-sensitive drum 1 is driven by a driving means (not shown in the figure) to rotate in the direction shown by an arrow. As shown in FIG. 3(*a*), the surface of the light-sensitive drum 1 is first uniformly charged at a predetermined voltage, for example −600 V, by the first electrical charger 2a. After that an image to be developed by the first color on the surface of the light-sensitive drum 1 is formed by the first exposing means 3a, whereby an electrostatic latent image corresponding to an image of the first color is formed as shown in FIG. 3(b). The exposure corresponding to the first color image may be carried out by exposing the image portion, for example, resulting in a reduction of the negative potential of the image portion to −100 V. As FIG. 3(*c*) shows, the electrostatic latent image corresponding to the first color image formed on the surface of the light-sensitive drum 1 is developed with toner of a first color, namely, red toner by the first developing device 4a, thus providing a toner image. At that time a DC voltage of, for example −450 V is applied to a developing sleeve of the first developing device 4a as the developing bias voltage.

The surface of the light-sensitive drum 1 is then uniformly charged at a predetermined voltage, for example −650 V, by the second electrical charger 2b as shown in FIG. 3(*d*), and the potential of the image portion of the first image rises to −600 V. After that an image to be developed by the second color on the surface of the light-sensitive drum 1 is formed by the second exposing means 3b, whereby an electrostatic latent image corresponding to an image of the second color is formed as shown in FIG. 3(*e*). The exposure corresponding to the second color image may also be carried out by exposing the image portion, for example, resulting in a reduction of the negative potential of the image portion to −100 V. As FIG. 3(*f*) shows, the electrostatic latent image corresponding to the second color image formed on the surface of the light-sensitive drum 1 is developed with toner of a second color, namely, black toner by the second developing device 4b, thus providing a toner image. At that time a predetermined developing bias voltage is applied to the non-magnetic cylindrical sleeve 11 of the second developing device 4b by the power supply 20 for developing bias voltage, as will be described later.

The toner image formed in red and black on the surface of the light-sensitive drum 1 is charged by the pre-transfer corotron 5 as required, whereby the first-color toner and second-color toner are made to have the same polarities when they are different polarities, and the transfer characteristics are improved by an increase of the charge amount. The first-color toner and the second-color toner are charged by the transfer corotron 6 and transferred to the recording medium 10. The separating corotron 7 charges the recording medium 10 so as to be separated from the surface of the light-sensitive drum 1. The recording medium 10 having been separated from the light-sensitive drum 1 is carried to a fuser (not shown in the figure) and toner images of two colors are fused on the surface of the recording medium 10, thus completing the color image recording.

After transferring toner image and separating the recording medium 10, residual toner on the surface of the light-sensitive drum 1 is removed by the cleaner 8, and then residual charge is exposed to the erase lamp 9 to be eliminated so that the light-sensitive drum 1 is able to prepare for the next process of color image recording.

In this embodiment, the developing bias voltage in at least the second and subsequent developing processes is an AC voltage superimposed on a DC voltage. The AC voltage waveform is such that the time from the maximum value of the electric field developing the electrostatic latent image (on an electrostatic latent image formation member) with toner to the minimum value of the electric field developing the electrostatic latent image (on an electrostatic latent image formation member) with toner is at least ½ of one cycle of the AC component.

Figure 4:
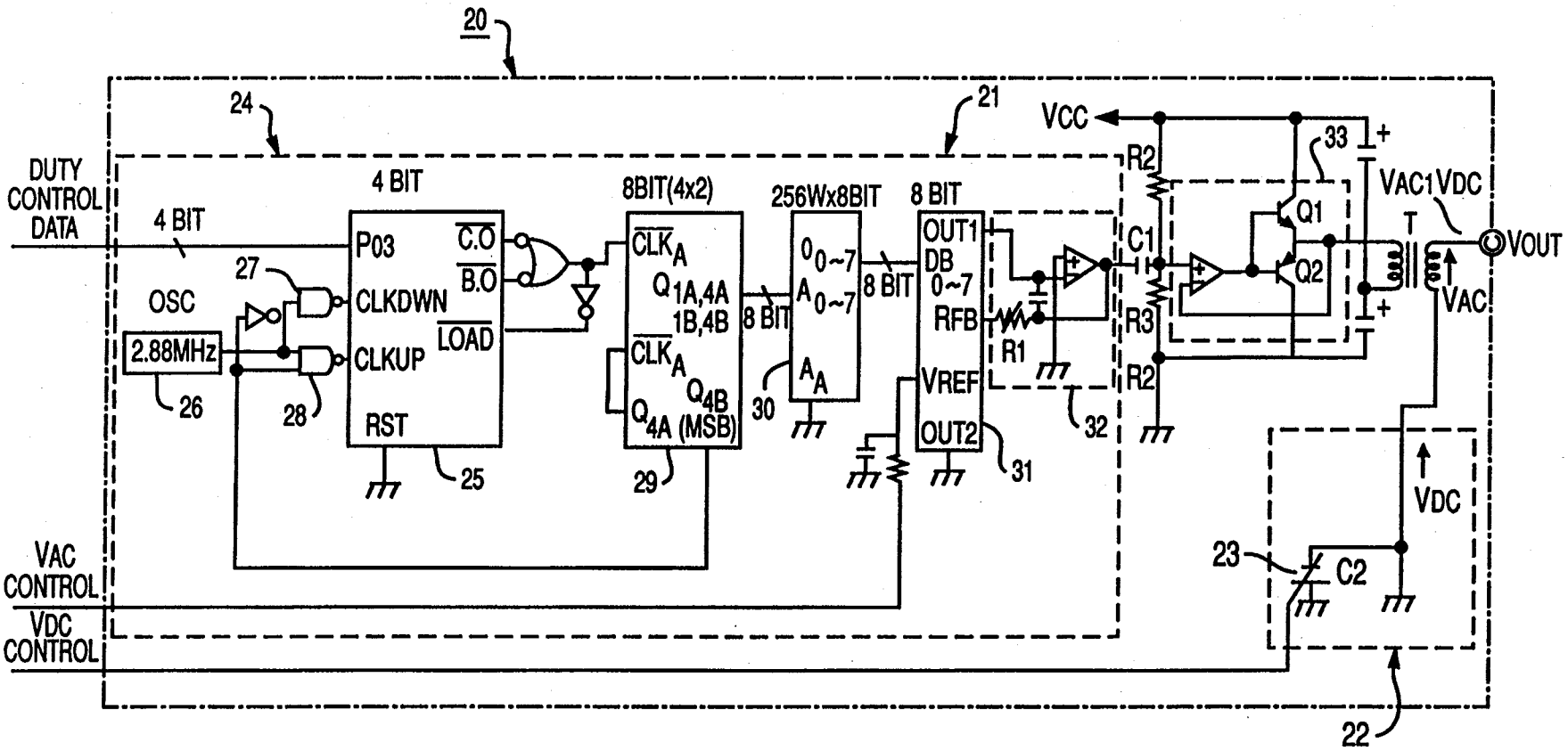
FIG. 4 shows a power supply circuit for a developing bias voltage.

FIG. 4 shows a circuit diagram of a developing bias voltage power supply for applying developing bias voltage to the second developing device.

In the figure, 20 refers to the developing bias voltage power supply, which comprises an AC voltage generator 21 and a DC voltage generator 22 for outputting AC voltage superimposed on a DC voltage.

Figure 5:
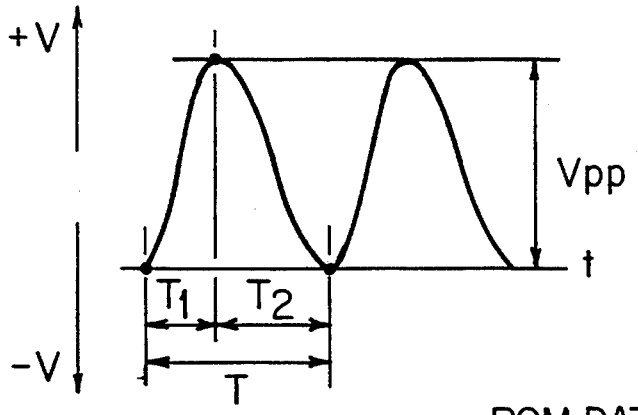
FIG. 5 shows the waveform of the AC component of the developing bias voltage.

As shown in FIG. 5, the AC voltage generator 21 is constructed to output AC voltage having different waveform depending on whether the gradient dv/dt of the AC voltage is positive or negative. That is, when the gradient dv/dt is positive, the AC voltage generator 21 generates an AC voltage $V_{AC}$ whose value $V_{AC1}$ is expressed by the following equation:

$$V_{AC1}=(V_{PP}/2)\times\sin(\omega_1 t)$$

and on the other hand, when dv/dt is negative, generates an AC voltage $V_{AC}$ whose value $V_{AC2}$ is expressed by the following equation:

$$V_{AC2}=(V_{PP}/2)\times\sin(\omega_2 t)$$

wherein $\omega_2$ is set to be larger than $\omega_1$ as will be explained later. The relation between $\omega_1$ and $\omega_2$ varies depending on the polarity of the toner.

The AC voltage generator 21 described above can generate an AC voltage of a predetermined frequency, in which the rise time $T_1$ from the minimum voltage $V_{min}$ to a maximum voltage $V_{max}$ and the fall time $T_2$ from the maximum voltage $V_{max}$ to the minimum voltage $V_{min}$ are different. Moreover, the AC voltage generator 21 can vary the ratio of the time for the voltage to change from the value such that the electric field developing the electrostatic latent image (on the electrostatic latent image formation member) is maximum to the value such that the electric field developing an electrostatic latent image (on the electrostatic latent image formation member) is minimum to one cycle of the AC component T, which is referred to as the fall-time factor $D_f$, where $D_f=T_1/(T_1+T_2)$. Correspondingly the rise-time factor $D_r$ is given by $D_r=T_2/(T_1+T_2)$. The period T of the AC voltage $V_{AC}$ is constant as follows:

$$T=T_1+T_2=1/f=1/1500\ s$$

where the frequency f is 1500 Hz, but the amplitude $V_{PP}$ of the AC voltage $V_{AC}$ can be changed.

Figure 7:
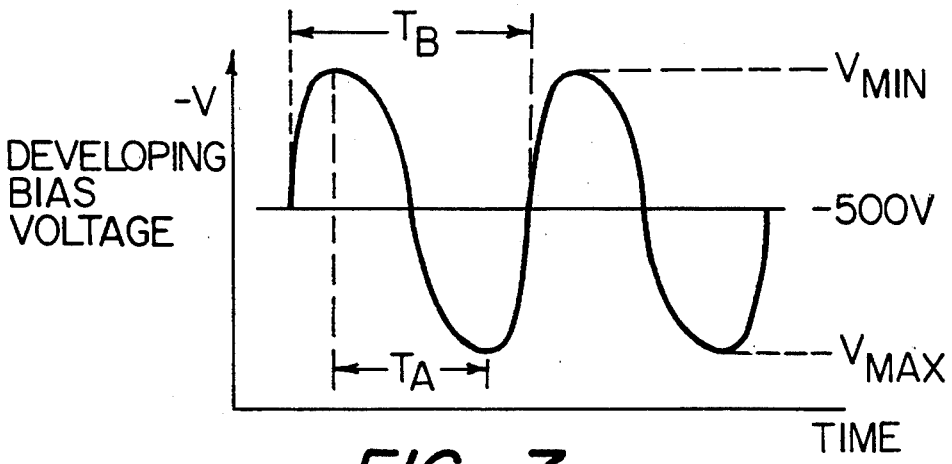
FIG. 7 shows a waveform of the developing bias voltage.

The rise-time factor $D_r$ and fall-time factor $D_f$ are collectively referred to as the active-time factor $D_a$. The reason for both the rise-time factor $D_r$ and fall-time factor $D_f$ corresponding to the active-time factor $D_a$ is that the direction of the electric field acting on the toner depends on the polarities of the developing bias voltage and the toner. As FIG. 7 shows, to conduct reverse development, that is, when the polarities of the developing bias voltage and toner are both negative, the voltage at which the electric field developing the electrostatic latent image with toner becomes maximum is $V_{min}$ in FIG. 7 and the voltage at which the electric field developing the electrostatic latent image with toner becomes minimum is $V_{max}$, and therefore the active-time factor in this case is $T_A/T_B$.

Figure 10:
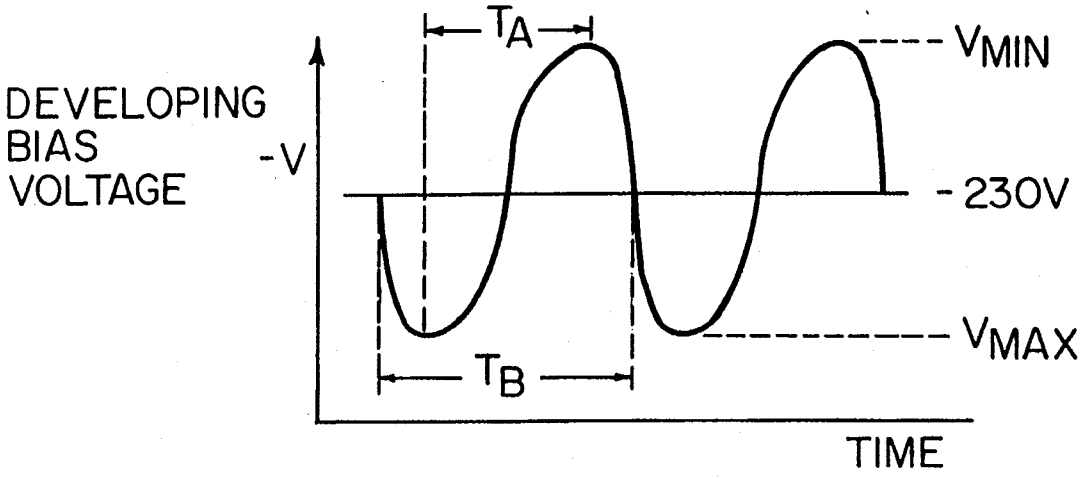
FIG. 10 shows another example waveform of the developing bias voltage.
Figure 13:
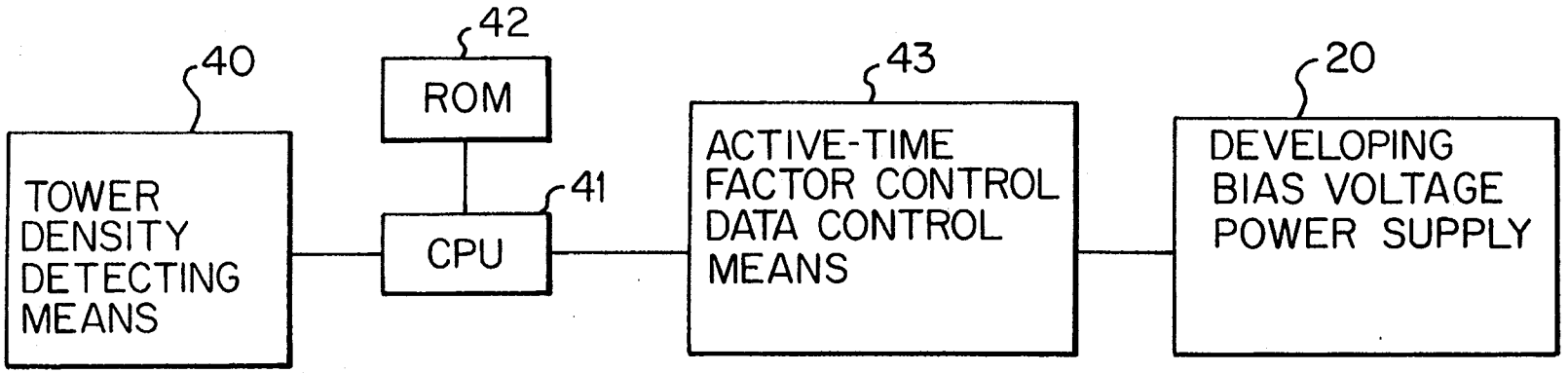
FIG. 13 is a block diagram of a control circuit of the developing device shown in FIG. 12.

On the other hand, when the polarity of the developing bias voltage is negative and the polarity of toner is positive, that is, to conduct normal development, the voltage at which the electric field developing the electrostatic latent image with toner becomes maximum is $V_{max}$ and the voltage at which the electric field developing the electrostatic latent image with toner becomes minimum is $V_{min}$ as shown in FIG. 10: therefore the active-time factor is given by $T_A/T_B$.

The DC voltage generator 22 consists of a DC power supply 23 which is well-known and provides a variable output voltage $V_{DC}$. The output voltage $V_{DC}$ is input to a capacitor C2, which acts as a bypass capacitor for the AC output current to be superimposed on the DC voltage. The above-described output voltage $V_{DC}$ can be controlled by an external $V_{DC}$ control signal.

The construction of the AC voltage generator 21 will now be described in more detail. The AC voltage generator 21 has a waveform signal generating means 24 which determines the waveform of the output AC voltage. The waveform signal generating means 24 has a first binary counter 25. The first binary counter 25, a pulse oscillator 26 connected thereto, and peripheral gate circuits constitute a circuit for changing the count-up timing of the address output to a PROM 30 from a second binary counter 29, as will be described later, depending on whether the most significant bit of the count value of the second binary counter 29 is zero or one.

The pulse oscillator 26 is connected to the first binary counter 25 through NAND circuits 27 and 28 and generates a clock pulse signal CLK of a predetermined frequency, for example 2.88 MHz. Through the NAND circuits 27 and 28, the clock pulse signal CLK generated by the pulse oscillator 26 is input to a CLKDWN terminal and a CLKUP terminal. Active-time ratio control data is input to the first binary counter 25 described above and can be selected appropriately by an active-time ratio control data setting means (not shown in the figure).

When the most significant bit of the output of the second binary counter 29 is zero, a signal which is input to the CLKDWN terminal of the first binary counter 25 inputs through the NOT and NAND circuits 27, and the first binary counter 25 decrements the active-time factor control data by one on every input of a clock pulse from the pulse oscillator 26. The first binary counter 25 then outputs a clock pulse signal from a B.O (borrow out) terminal each time a count-down series is finished. For that reason, the frequency of the clock pulse signal output from the first binary counter 25 is (the frequency of the pulse oscillator 26)×(active-time factor control data). On the other hand, when the most significant bit of the output of the second binary counter 29 is one, a signal is input to the CLKUP terminal of the first binary counter 25 through NAND circuit 28, and the first binary counter 25 increments the active-time factor control data by one on every input of a clock pulse from the pulse oscillator 26, and further outputs the clock pulse signal from a C.O (carry out) terminal each time a count-up series is finished. For that reason, the frequency of the clock pulse signal output from the first binary counter 25 is (the frequency of the pulse oscillator 26)×(15−active-time factor control data).

The clock pulse signal output from the first binary counter 25 is then input to the second binary counter 29. The second binary counter 29 counts based on the clock pulse signal output from the first binary counter 25 and outputs a signal corresponding to a count value from output terminals $Q(_{1A}...Q_{4B})$. At the same time, the second binary counter 29 also outputs the most significant bit of the count value from the relevant output terminal Q to the first binary counter 25.

The counting of the second binary counter 29 is conducted based on the clock pulse signal output from the first binary counter 25. As described above, the clock pulse signal has different output frequencies as the most significant bit of the output of the binary counter 29 is zero or one; therefore, the frequency of count values output from the second binary counter 29 depends on whether the most significant bit of the output of the binary counter 29 is zero or one.

Figure 6:
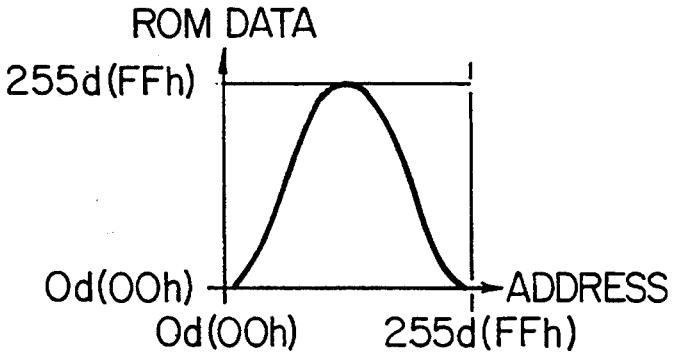
FIG. 6 shows waveform data stored in a PROM.

The signal output from the second binary counter 29 is input to the PROM 30. As shown in FIG. 6, data values corresponding to sine wave are stored in the PROM 30 with addresses in the range 0*d* (00*h*) to 255*d* (7Fh). The PROM 30 outputs sine waveform data in accordance with the address signal input from the second binary counter 29; therefore the PROM 30 outputs a waveform similar to the sine wave shown in FIG. 6 when the signals are input from the second binary counter 29 with a predetermined period.

As described above, the signal output from the second binary counter 29 has different frequencies based on the active-time factor control data depending on whether the most significant bit of the count value of the second binary counter 29 is zero or one. As a result, the PROM 30 outputs data which corresponds to waveform of sine wave and has different frequencies in accordance with whether the gradient of the sine wave dv/dt is positive (rise portion) or negative (fall portion).

The output data from the PROM 30 described above is then input to a digital-analog converter 31 which outputs an analog current from output terminal OUT1 corresponding to the output data of PROM 30 shown in FIG. 6. A $V_{AC}$ control signal is input to the digital-analog converter 31 and a current output is linearly modulated by the $V_{AC}$ control signal, which makes it possible to linearly control the amplitude of the output current from the digital-analog converter 31 using the $V_{AC}$ control signal.

The output current from the digital-analog converter 31 is further input to an I/V converter 32 to undergo current-to-voltage conversion. The output from the I/V converter 32 is output to a buffer amplifier 33 through a capacitor C. At that time, the I/V converter 32 can control the gain by a variable resistance R1 so that the required AC output voltage is obtained using the $V_{AC}$ control signal.

An AC voltage is output from the buffer amplifier 33 corresponding to the waveform signal output from the waveform signal generating means 24 such as described above, and increased by a transformer T, and then output from an output terminal $V_{OUT}$ to the second developing device 4*b* as the developing bias voltage superimposed on a DC voltage.

If the voltage $V_{AC}$ is 1500 V and the output of the buffer amplifier 33 is 15 V, the transformer T has a transformer ratio of 100. The buffer amplifier 33 is a power buffer whose voltage gain is 1 and its output of AC voltage $V_{AC}$ is the output of the voltage waveform from the waveform signal generating means 24 multiplied by the transformer ratio of the transformer T.

As described above, the active-time factor ($D_a=T_1/(T_1+T_2)$) of the AC voltage $V_{AC}$ output from the AC voltage generator 21 can be varied in accordance with the active-time factor control data. That is, as shown in FIG. 5, the time $T_2$ for the voltage to change from the value such that the electric field developing the electrostatic latent image on the electrostatic latent image formation member is maximum to the value such that the electric field developing an electrostatic latent image on the electrostatic latent image formation member is minimum is expressed by:

$T_2$=(the period of the pulse oscillator 26)×(15−active-time factor control data)×128 and the remainder $T_1$ is expressed by:

$T_1$=(the period of the pulse oscillator 26)×active-time factor control data×128.

The number 128 is half of the number of data values for one period stored in the PROM 30, and accordingly, one period of the AC voltage T is:

$T=T_1+T_2$=(the period of the pulse oscillator 26)×15×128, and the active-time factor is given by:

$D_a$=active-time factor control data/15.

When the frequency of the pulse oscillator 26 is 2.88 MHz, the output is 1500 Hz. As shown in the table below, the active-time factor can be controlled in accordance with the equation $D_a$=active-time factor control data/15.

TABLE 1

| Active-time factor control data | $D_a$ |
|---|---|
| 2d | 0.133 |
| 3d | 0.200 |
| 4d | 0.267 |
| 5d | 0.333 |
| 6d | 0.400 |
| 7d | 0.467 |
| 8d | 0.533 |
| 9d | 0.600 |
| 10d | 0.667 |
| 11d | 0.733 |
| 12d | 0.800 |
| 13d | 0.867 |

The AC voltage generator of this embodiment has been explained based on the construction shown in FIG. 4, but it is clear that the active-time factor of the AC voltage $V_{AC}$ can be controlled with higher resolution by altering the first binary counter 26 and its peripheral circuits. Though the waveform signal generating means 24 is installed inside the power supply 20 in FIG. 4, the waveform signal can equally be generated by a CPU and digital-analog converter in the controller and the power supply 20 may be constituted without the buffer amplifier 33 and the DC voltage generator 22. Moreover, analog circuits can also be used to generate the waveform signal, though the waveform signal generating means 24 consists of digital circuits in this embodiment. The analog circuits can be substituted for the digital circuits.

The color image recording apparatus of this embodiment having the above-described construction carries out development by the second developing device as follows.

After formation of the first toner image, a second electrostatic latent image is formed on the surface of the light-sensitive drum and then developed by the second developing device **4*b*, that is, the second electrostatic latent image formed on the light-sensitive drum 1 is developed by toner contained in developer attached to the surface of the non-magnetic cylindrical sleeve 11 as shown in FIG. 2. At that time, an AC voltage superimposed on a predetermined DC voltage is applied as a developing bias voltage having waveform shown in FIG. 7 by the developing bias voltage power supply 20. Negatively charged toner contained in the developer is therefore ejected toward the light-sensitive drum 1 from the non-magnetic cylindrical sleeve 11 by the electric field formed by the AC component of the developing bias voltage. The AC voltage is applied so that the time from a point that the voltage makes the electric field developing the electrostatic latent image by toner maximum to a point that the voltage makes the electric field developing the electrostatic latent image by toner minimum is ½ or more of one period of the AC component. Consequently, the electric field E generated by the above-described AC voltage applies a force F expressed as follows to toner to be ejected toward the light-sensitive drum 1 from the non-magnetic cylindrical sleeve 11**.

$$F=qE$$

If the spacing between the light-sensitive drum 1 and the non-magnetic cylindrical sleeve 11 is d, E is expressed by the following equation:

$$E=\Delta V/d=(V_{BIAS}-V_{IMAGE})/d$$

and then the motion of the toner mentioned above can be described by an equation of motion as follows:

$$F=ma=qE.$$

Figure 8:
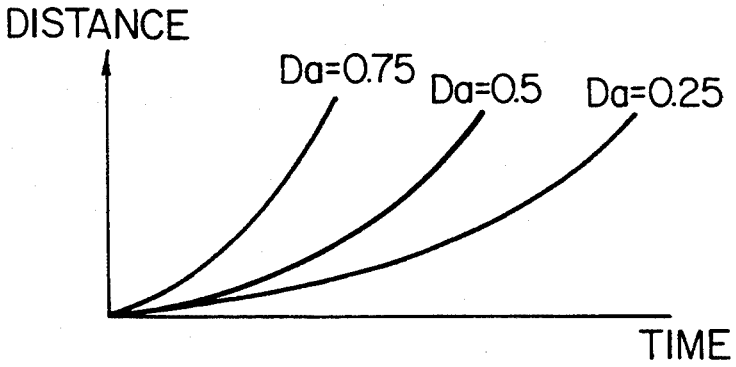
FIG. 8 is a graph showing the relation between position and time of ejected toner.
Figure 9A:
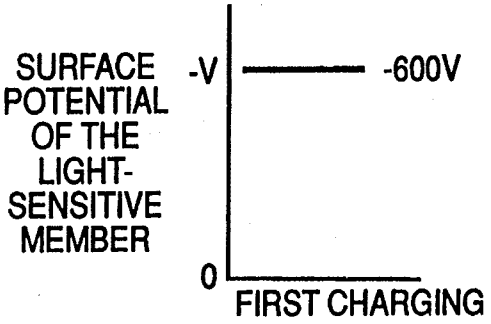
FIGS. 9(*a*)–(*e*) illustrate potentials in a second embodiment of the image formation process.
Figure 9B:
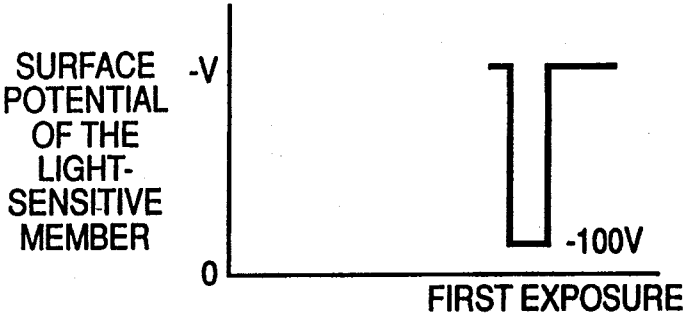
Figure 9C:
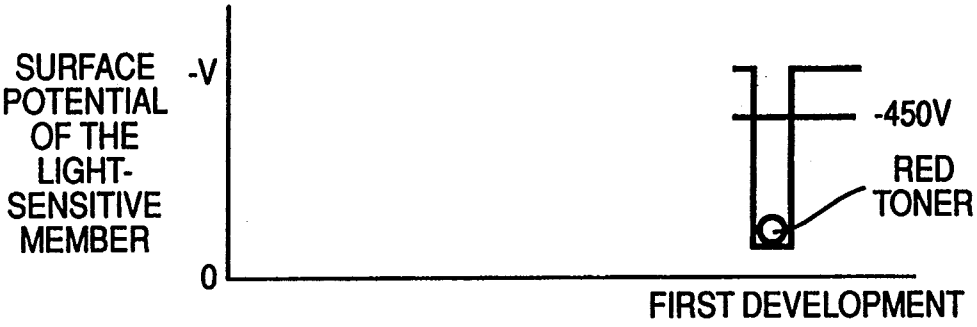
Figure 9D:
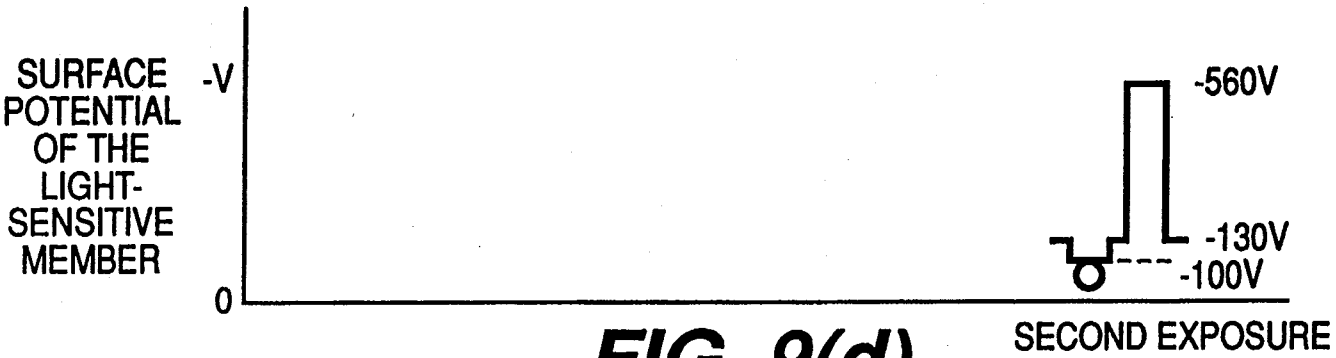
Figure 9E:
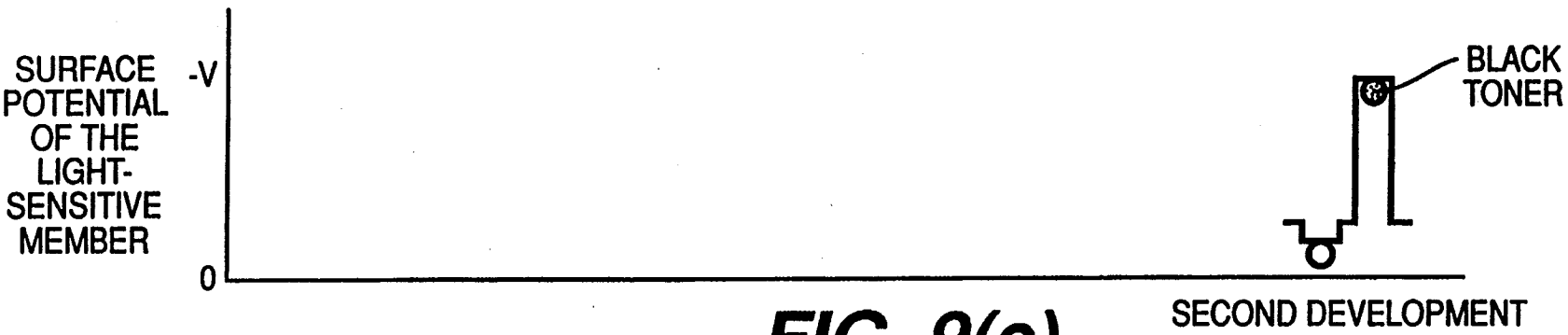

That is to say, the force F=qE is applied to toner, and the time for the acceleration effective to move the toner in the direction which develops the second electrostatic latent image on the light-sensitive drum 1 to change from the maximum to minimum is increased. For this reason, the distance moved by the toner in a certain time is increased as the ratio of the time for the voltage $T_2$ to change from the value such that the electric field carrying out development is maximum to the value such that the electric field carrying out development is minimum to one period T of the AC component, namely, the active-time factor increases as shown in FIG. 8. Toner is ejected toward the light-sensitive drum 1 easily, which leads to effective development of the second electrostatic latent image and prevents reduction of the second toner density.

The waveform of the developing bias voltage is set to be such that an average voltage value of the maximum and minimum voltage is equal to the average voltage during one cycle; therefore, the second toner does not easily attach to the first toner image already developed, thus avoiding turbulence of the first image, reduction of the image density, and color mixing, and preventing the first toner from entering the second developing device.

In the second developing device **4*b*, the magnetic roller 12 is fixed inside the rotatable non-magnetic cylindrical sleeve 11 so that an approximate midpoint between magnetic poles 14 and 15 faces the light-sensitive drum 1. A magnetic brush formed between the magnetic poles 14 and 15 in the magnetic roller 12 is approximately parallel to the surface of the light-sensitive drum 1, and therefore, a uniform magnetic brush, not a non-uniform magnetic brush, acts on the light-sensitive drum 1**, which forms a toner image of predetermined density efficiently and precisely.

Second Embodiment

Figure 11:
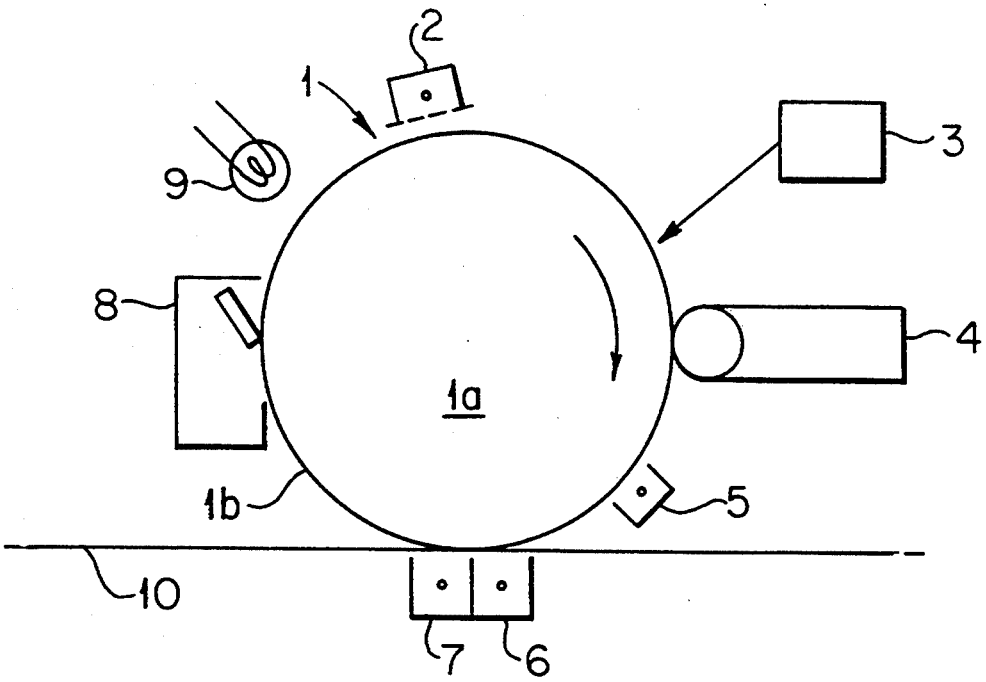
FIG. 11 shows the construction of an embodiment of the color image recording apparatus used for experimental purposes in a third embodiment.

Now a second embodiment of the present invention will be described, in which the ratio of time for the AC component of the developing bias voltage to change from a value such that the electric field developing the electrostatic latent image is maximum to a value such that the electric field becomes minimum to one period of AC component is adjustable. FIG. 11 is the same as FIG. 1 except for the exposing means 3 and developing device 4.

Figure 12:
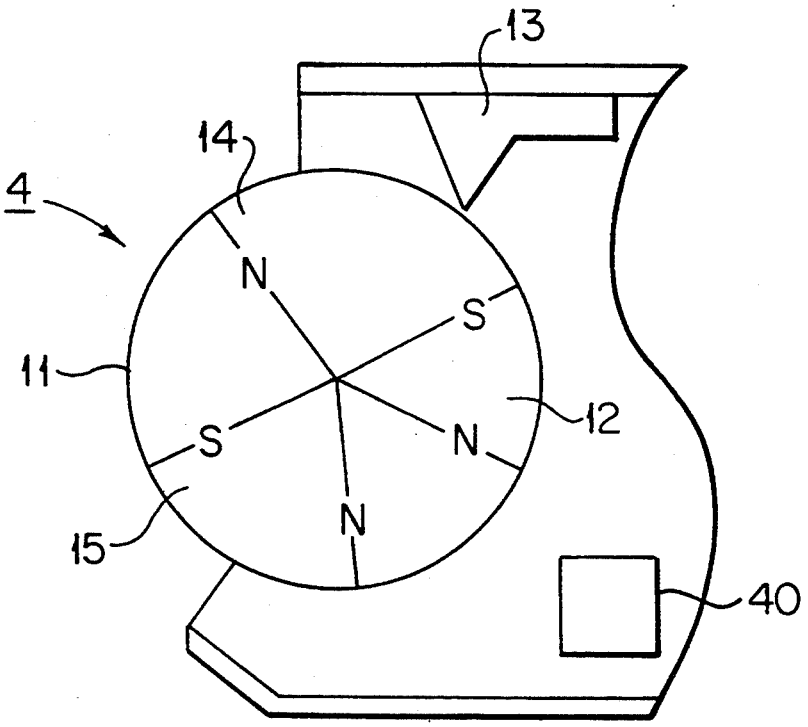
FIG. 12 shows the construction of a developing device of a color image recording apparatus used in a second embodiment.

The developing bias voltage power supply 20 is the same as the one shown in FIG. 4. As shown in FIG. 12, a toner density detection means 40 consisting of a piezoelectric element or the like is installed inside the housing of the developing device 4. The output from the toner density detection means 40 is input to a CPU 41 which determines a active-time factor by referring to a lookup table previously stored in a ROM 42 so that the predetermined image density may be obtained. The active-time factor determined by the CPU 41 is input to an active-time factor control means 43. The active-time factor control means 43 inputs a digital active-time factor control data value as shown in Table 1 to the developing bias voltage power supply 20.

By using the developing device 4 in the color image recording apparatus of FIG. 11, the image density can be adjusted without fogging or development of carrier particles when the toner density varies as a result of toner shortage. The developing density may be equally detected instead of the toner density. The active-time factor mentioned above can be changed manually in accordance with the image density.

First experiment

Using the color image recording apparatus shown in FIG. 1, a color image was experimentally recorded using image exposure in the first and second exposure and reverse development in the first and second development. The toner was negatively charged both in the first developer and in the second developer.

Now the image formation process in this first experiment will be explained based on FIG. 3.

As shown in FIG. 3(*a*), the surface of an OPC light-sensitive drum 1 is uniformly charged to −600 V by a first electrical charger 2*a*. Image exposure is carried out by using a laser beam to form a negative latent image having an exposed portion potential of −100 V (FIG. 3(*b*)). The negative latent image is reverse developed by a first developing device 3*a* with a DC component of the developing bias voltage of −450 V (FIG. 3(*c*)). Second charging is carried out by the second electrical charger 2*b* as shown in FIG. 3(*d*). After that, the potentials of the first image portion and the first background (non-image) portion are −600 V and −650 V, respectively. A negative latent image with an exposed portion potential of −100 V is formed by a laser beam (FIG. 3(*e*)), and then reverse developed by a second developing device 3*b* (FIG. 3(*f*)).

The second developing device 3*b* used in this experiment will now be illustrated based on FIG. 2.

In this experiment, the spacing between the light-sensitive drum 1 and the non-magnetic cylindrical sleeve 11 is set to be 500 μm and thickness of the developer layer where it faces the light-sensitive drum 1 is set to be 350 μm. The outside diameter of the non-magnetic cylindrical sleeve 11 is 25 mm. The magnetic pole 14 is at 70° to the magnetic pole 15.

A developing bias voltage, which comprises an AC voltage superimposed on a DC voltage, is applied to the nonmagnetic cylindrical sleeve 11 by the developing bias voltage power supply 20. The DC component of the developing bias voltage is set to be −500 V to prevent fogging and color mixing in the first image.

Here, a frequency of 1500 Hz is employed for the AC component of the second developing bias voltage and the voltage and active-time factor are varied to investigate the relation between the active-time factor and reduction of the first and second developing densities, and deterioration of the first toner image. The waveform of the developing bias voltage is shown in FIG. 7. Here, the AC voltage $V_{P-P}$ refers to $|V_{max}-V_{min}|$. The active-time factor is, as described above, the ratio of the time ($T_A$) for the voltage to vary from the value such that the electric field developing the electrostatic latent image on the light-sensitive drum 1 is maximum to the value such that the electric field developing the electrostatic latent image on the light-sensitive drum 1 is minimum to the period of the AC component $T_B$.

The result of the above-described experiment is shown in Table 2 below. To evaluate the result of the experiment, and in particular to evaluate the image density, a solid image was measured using a reflection densitometer (trade name: "X-RITE 310"). For the second image density, a density of at least 1.3 is sufficient both for solid blocks and line images, and therefore an image density of 1.3 or more is indicated as "Good" and less than 1.3 is indicated as "Poor" in the table. The reduction of the first image density is measured by the difference obtained by subtracting the density of a two-color image after second development from the density of a one-color image: "Good" indicates that there is no difference and "Bad" shows that there is a difference, that is, that reduction of the first image density occurs. Deterioration of the first image is measured by the degree of its occurrence, where "Good" shows that no deterioration occurs, "Acceptable" shows that some deterioration occurs but is acceptable from a practical viewpoint (the rate of thickening of a linear image is not more than ±10%), and "Bad" indicates that image deterioration is unacceptable (the rate of thickening of a linear image is in excess of ±10%).

TABLE 2

| $V_{P-P}$ (kV) | Active-time factor | Deterioration of the first image | Reduction of the first image density | | Second image density | |
|---|---|---|---|---|---|---|
| 0.75 | 0.25 | Good | 0.0 | Good | 1.20 | Poor |
| | 0.40 | Good | 0.0 | Good | 1.25 | Poor |
| | 0.50 | Good | 0.0 | Good | 1.30 | Good |
| | 0.60 | Good | 0.0 | Good | 1.32 | Good |
| | 0.75 | Good | 0.0 | Good | 1.35 | Good |
| 1.00 | 0.25 | Good | 0.0 | Good | 1.25 | Poor |
| | 0.40 | Good | 0.0 | Good | 1.28 | Poor |
| | 0.50 | Good | 0.0 | Good | 1.35 | Good |
| | 0.60 | Good | 0.0 | Good | 1.38 | Good |
| | 0.75 | Good | 0.0 | Good | 1.40 | Good |
| 1.50 | 0.25 | Acceptable | 0.0 | Good | 1.36 | Good |
| | 0.40 | Acceptable | 0.0 | Good | 1.39 | Good |
| | 0.50 | Acceptable | 0.0 | Good | 1.40 | Good |
| | 0.60 | Acceptable | 0.0 | Good | 1.40 | Good |
| | 0.75 | Acceptable | 0.0 | Good | 1.40 | Good |
| 2.00 | 0.25 | Bad | 0.3 | Bad | 1.40 | Good |
| | 0.40 | Bad | 0.3 | Bad | 1.40 | Good |
| | 0.50 | Bad | 0.3 | Bad | 1.40 | Good |
| | 0.60 | Bad | 0.3 | Bad | 1.40 | Good |

TABLE 2-continued

| $V_{P-P}$ (kV) | Active-time factor | Deterioration of the first image | Reduction of the first image density | | Second image density | |
|---|---|---|---|---|---|---|
| | 0.75 | Bad | 0.3 | Bad | 1.40 | Good |

As will be seen from Table 2, by setting the active-time factor to be 0.5 or more for the same voltage value $V_{PP}$, the efficiency of development is improved. In other words, by making the time $T_2$ for the voltage to change from a value such that the electric field developing the electrostatic latent image on the light-sensitive drum 1 is maximum to a value such that the electric field developing the electrostatic latent image on the light-sensitive drum 1 is minimum is ½ or more of one period of the AC component T, the efficiency of development is improved. If the active-time factor is set to be as described above, a sufficient image density can be obtained when the voltage is at least 0.75 kV. When the voltage $V_{PP}$ is 2 kV, the electric field to remove toner from the surface of the light-sensitive drum 1 grows in force, and therefore reduction of the first image density or deterioration of the first image occurs. If the active-time factor is set to be as is mentioned above and the voltage value $V_{PP}$ is set to be from 0.75 kV to 2 kV, a sufficient developing density can be obtained without reducing the first image density or causing deterioration of the first image.

Second experiment

Color image recording was carried out using the color image recording apparatus shown in FIG. 1, adopting image portion exposure for the first exposure, background (non-image) portion exposure for the second exposure, reverse development for the first development and normal development for the second development. The toner contained in the first developer was negatively charged, and the toner contained in the second developer was positively charged.

Now the image formation process is explained based on FIGS. 9(*a*)–9(*e*).

The surface of the OPC light-sensitive drum 1 is uniformly charged to −600 V by the first electrical charger 2*a* (shown in FIG. 9(*a*)). The image portion exposure is carried out by using a laser beam to form a negative latent image having an exposed portion potential of −100 V (FIG. 9(*b*)). The negative latent image is reverse developed with a developing bias voltage of −450 V by the first developing device 3*a* (shown in FIG. 9(*c*)). Next, a positive latent image having an exposed portion potential of −130 V was formed by the laser beam (shown in FIG. 9(*d*)). After the second exposure, the potential of the first image portion is −100 V, and the potential of the background (non-image) portion is −560 V. Here, the normal development is carried out by the second developing device 3*b* (shown in FIG. 9(*e*)). In this experiment, a second electrical charger 2*b* does not carry out charging, and therefore, the second electrical charger 2*b* may be omitted.

The second developing device 4*b* used in this experiment is the same as that of the first experiment. The developing bias voltage has an AC voltage superimposed on a DC voltage. The AC component of the developing bias voltage is set to be −230 V to prevent fogging and color mixing with the first image.

Here, the relation between different values of the voltage value and the active-time factor and reduction of the second developing density, reduction of the first image density and deterioration of the first image is examined by adopting a frequency of 1500 Hz for the AC component of the second developing bias voltage. The waveform of developing bias voltage is shown in FIG. 10, wherein $V_{P-P}$ refers to $|V_{max}-V_{min}|$. The active-time factor refers to the ratio of the time $T_A$ to change from the voltage $V_{max}$ at which the electric field developing the electrostatic latent image on the light-sensitive drum 1 is maximum to the voltage $V_{min}$ at which the electric field developing the electrostatic latent image on the light-sensitive drum 1 is minimum to one period of the AC component of the developing bias voltage $T_B$. The evaluation was carried out in the same way as in the first experiment. The result is shown in Table 3 below.

TABLE 3

| $V_{P-P}$ (kV) | Active-time factor | Deterioration of the first image | Reduction of the first image density | | Second image density | |
|---|---|---|---|---|---|---|
| 0.75 | 0.25 | Good | 0.0 | Good | 1.23 | Poor |
| | 0.40 | Good | 0.0 | Good | 1.27 | Poor |
| | 0.50 | Good | 0.0 | Good | 1.31 | Good |
| | 0.60 | Good | 0.0 | Good | 1.35 | Good |
| | 0.75 | Good | 0.0 | Good | 1.38 | Good |
| 1.00 | 0.25 | Good | 0.0 | Good | 1.25 | Poor |
| | 0.40 | Good | 0.0 | Good | 1.28 | Poor |
| | 0.50 | Good | 0.0 | Good | 1.33 | Good |
| | 0.60 | Good | 0.0 | Good | 1.37 | Good |
| | 0.75 | Good | 0.0 | Good | 1.40 | Good |
| 1.50 | 0.25 | Acceptable | 0.0 | Good | 1.37 | Good |
| | 0.40 | Acceptable | 0.0 | Good | 1.40 | Good |
| | 0.50 | Acceptable | 0.0 | Good | 1.40 | Good |
| | 0.60 | Acceptable | 0.0 | Good | 1.40 | Good |
| | 0.75 | Acceptable | 0.0 | Good | 1.40 | Good |
| 2.00 | 0.25 | Bad | 0.15 | Bad | 1.40 | Good |
| | 0.40 | Bad | 0.15 | Bad | 1.40 | Good |
| | 0.50 | Bad | 0.15 | Bad | 1.40 | Good |
| | 0.60 | Bad | 0.15 | Bad | 1.40 | Good |
| | 0.75 | Bad | 0.15 | Bad | 1.40 | Good |

As will be seen from Table 3, by setting the active-time factor to be 0.5 or more for the same voltage value $V_{PP}$, the developing efficiency is improved. In other words, by making the time $T_2$ for the voltage to change from a value such that the electric field developing the electrostatic latent image on the light-sensitive drum 1 is maximum to a value such that the electric field developing the electrostatic latent image on the light-sensitive drum 1 is minimum is ½ or more of one period of the AC component T, the efficiency of development is improved. If the active-time factor is set to be as described above, a sufficient image density (1.3 or more) can be obtained when the voltage is 0.75 kV or more. When the voltage $V_{PP}$ is 2 kV, the electric field to remove toner from the surface of the light-sensitive drum 1 grows in force, and therefore reducing of the first image density or turbulence of the first image occur. If the duty factor is set to be as is mentioned above and the voltage value $V_{PP}$ is set to be within 0.75 kV to 2 kV, sufficient (satisfactory) developing density can be obtained without reducing the first image density and causing turbulence of the first image.

Third experiment

An experiment using different active-time factors in image formation was carried out using the color image recording apparatus shown in FIG. 11 under the following conditions:

Exposure: image portion exposure

Development: non-contact, two-component, reverse development

Developer: negatively charged black toner (average particle diameter 10 μm), positively charged carrier with magnetic particles dispersed in it (average particle diameter 45 μm, density 2.2 g/cm$^3$)

Toner concentration: 3%, 9%, 12% and 15%

Process speed: 200 mm/sec

Figure 14A:
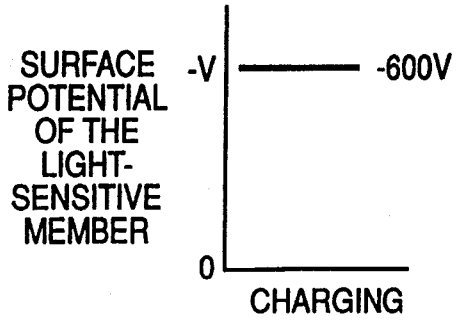
FIG. 14(*a*), 14(*b*) and 14(*c*) illustrate potentials in image formation process in a third experiment.
Figure 14B:
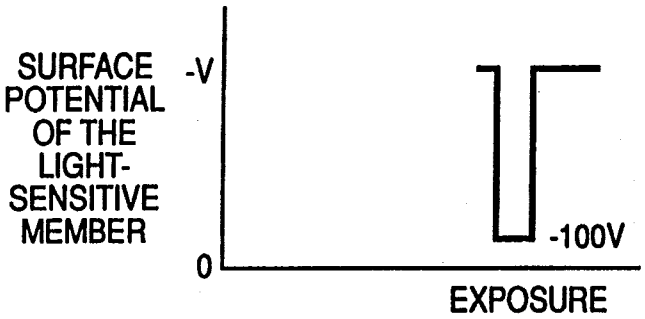
Figure 14C:
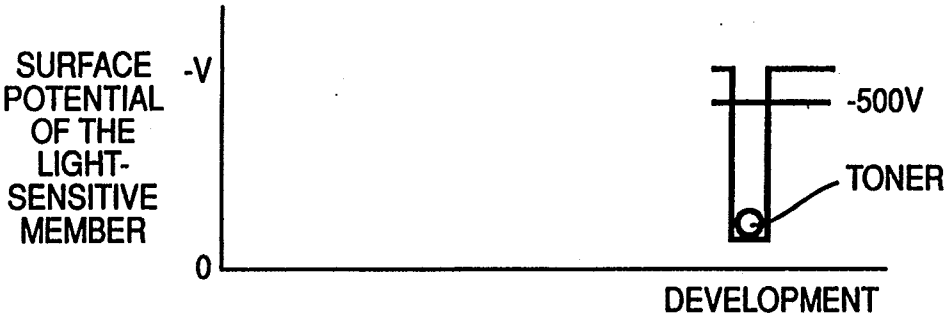

Process of image formation: as shown in FIG. 14

DC component of developing bias voltage: −500 V

AC component of developing bias voltage: composite sine wave with frequency of 1500 Hz and $V_{P-P}$ of 1.5 kV The results of this experiment are shown in Table 4. The density of the second image was evaluated in the same way as in the first and second experiments. With regard to fogging, "None" indicates that no fogging occurred, "Acceptable" indicates that some fogging occurred but was acceptable from a practical viewpoint, and "Bad" indicates that fogging occurred and the active-time factor is inadequate. To evaluate the carrier particle attachment, the area ratio of carrier particles in the background portion was measured by an image resolution apparatus in comparison with an image in which the area ratio of line images to the background portion is 1:1 and the lines are formed at a spacing of 2 lines per mm. In Table 4, "Good" indicates that the area ratio is less than 1.0, and "Poor" indicates that it is 1.0 or more.

TABLE 4

| Toner concentration(% | Duty factor | Image density | | Occurrence of fogging | Carrier area ratio | | Overall evaluation |
|---|---|---|---|---|---|---|---|
| 3 | 0.25 | 1.11 | Poor | None | 0.49 | Good | Poor |
| | 0.40 | 1.18 | Poor | None | 0.43 | Good | Poor |
| | 0.50 | 1.24 | Poor | None | 0.24 | Good | Poor |
| | 0.60 | 1.31 | Good | None | 0.17 | Good | Good |
| | 0.75 | 1.35 | Good | None | 0.12 | Good | Good |
| 9 | 0.25 | 1.21 | Poor | None | 0.71 | Good | Poor |
| | 0.40 | 1.27 | Poor | None | 0.62 | Good | Poor |
| | 0.50 | 1.34 | Good | None | 0.44 | Good | Good |
| | 0.60 | 1.38 | Good | None | 0.37 | Good | Good |
| | 0.75 | 1.40 | Good | None | 0.25 | Good | Good |
| 12 | 0.25 | 1.36 | Good | None | 0.89 | Good | Good |
| | 0.40 | 1.39 | Good | None | 0.77 | Good | Good |
| | 0.50 | 1.40 | Good | None | 0.59 | Good | Good |
| | 0.60 | 1.40 | Good | Acceptable | 0.45 | Good | Good |
| | 0.75 | 1.40 | Good | Acceptable | 0.29 | Good | Good |
| 15 | 0.25 | 1.40 | Good | None | 0.93 | Good | Good |
| | 0.40 | 1.40 | Good | Acceptable | 0.87 | Good | Good |
| | 0.50 | 1.40 | Good | Acceptable | 0.72 | Good | Good |
| | 0.60 | 1.40 | Good | Bad | 0.51 | Good | Poor |
| | 0.75 | 1.40 | Good | Bad | 0.32 | Good | Poor |

As will be seen from Table 4, when the duty factor is high, the image density increases and fogging increases. On the other hand, the rate of attachment of carrier particles is reduced, and therefore the image density can be adjusted while preventing the occurrence of fogging and the attachment of carrier particles.

Fourth experiment

A fourth experiment was carried out in the same way as the third experiment except that three types of toner, with charge densities of −3 μC/g, −8 μC/g, and −12 μC/g were used and the toner concentration was constant at 9%. The results of the experiment are shown in Table 5.

TABLE 5

| Charge density | Duty factor | Image density | | Occurrence of fogging | Carrier area ratio | | Overall evaluation |
|---|---|---|---|---|---|---|---|
| −3 | 0.25 | 1.11 | Poor | None | 0.49 | Good | Poor |
| μC/g | 0.40 | 1.18 | Poor | None | 0.43 | Good | Poor |
| | 0.50 | 1.24 | Poor | None | 0.24 | Good | Poor |
| | 0.60 | 1.31 | Good | None | 0.17 | Good | Good |
| | 0.75 | 1.35 | Good | None | 0.12 | Good | Good |
| −8 | 0.25 | 1.21 | Poor | None | 0.71 | Good | Poor |
| μC/g | 0.40 | 1.27 | Poor | None | 0.62 | Good | Poor |
| | 0.50 | 1.34 | Good | None | 0.44 | Good | Good |
| | 0.60 | 1.38 | Good | None | 0.37 | Good | Good |
| | 0.75 | 1.40 | Good | None | 0.25 | Good | Good |
| −12 | 0.25 | 1.36 | Good | None | 0.89 | Good | Good |
| μC/g | 0.40 | 1.39 | Good | None | 0.77 | Good | Good |
| | 0.50 | 1.40 | Good | None | 0.59 | Good | Good |
| | 0.60 | 1.40 | Good | Acceptable | 0.45 | Good | Good |
| | 0.75 | 1.40 | Good | Acceptable | 0.29 | Good | Good |

As will be seen from Table 5, when the charge density of the toner is small, the image density becomes low and on the other hand, if the charge amount of toner is large, the carrier particles tend to attach to the recording medium. By controlling the active-time factor in accordance with the charge density of the toner, the image density can be adjusted while preventing fogging and carrier attachment.

The above-described control of the active-time factor may be carried out in combination with control of the DC component of the developing bias voltage, control of the charging potential or control of the exposure amount. A contact developing method or a one-component developing method may equally serve as the developing method.

A composite sine wave is adopted as the waveform of the AC component of the second developing bias voltage in the above-described embodiment, but a triangular pulse wave or other waveform may also provide the same effect.

The above-described embodiment may be applied to a non-contact developing method using a two-component developer or a contact developing method for the second development. Moreover, they can also use a contact magnetic brush developing method with a low contact friction force using a single-component magnetic toner or a two-component developer.

Furthermore, though the approximate midpoint between the opposite magnetic poles adjacent to each other in the developer holding member faces the electrostatic latent image formation member in the embodiment described above, it is possible to make the approximate midpoint between similar magnetic poles adjacent to each other face the electrostatic latent image formation member. The above-described embodiment is also adaptable to a developing method in which a magnetic pole in the developer holding member approximately faces the electrostatic latent image formation member.

A light-sensitive member is employed as the latent image formation member in the embodiment described above. However, a dielectric member may be used as the latent image formation member to form the electrostatic latent image by an electrical discharge recording member such as used in an electrostatic printer or by an ion current control head as disclosed in Japanese Patent Application Unexamined Publication No. Sho. 59-190854 (1984), and the like.

Additionally, the above-described embodiments relate to recording apparatuses for two-color reproduction, but the electrostatic latent image formation process is not limited to these embodiments and may also be used in a recording apparatus for three or more colors.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A color image recording apparatus comprising:

an electrostatic latent image formation member;

a first toner image forming means for forming a first toner image electrostatically on said electrostatic latent image formation member;

a second toner image forming means for forming a second toner image electrostatically on said electrostatic latent image formation member on which said first toner image has already been formed; and a developing bias voltage applying means for applying a developing bias voltage to said second toner image forming means, wherein said developing bias voltage comprises of a DC component and an AC component of a predetermined period and said AC component has a waveform such that the time for the voltage to change from a value such that an electric field making toner move toward said electrostatic latent image formation member is maximum to a value such that said electric field becomes minimum is set to be at least ½ of said predetermined period of said AC component.

2. The color image recording apparatus according to claim 1, wherein said second toner image forming means comprises a developing sleeve, a two-component developer comprising toner particles and magnetic carrier particles and being held on said developing sleeve, and a magnet located in said developing sleeve.

3. The color image recording apparatus according to claim 2, wherein said two-component developer is placed without contacting said electrostatic latent image formation member.

4. The color image recording apparatus according to claim 3, wherein said magnet has a plurality of magnetic poles and an area between two of said plurality of magnetic poles faces said electrostatic latent image formation member.

5. A color image recording method comprising the steps of:

attaching a first toner electrostatically to an electrostatic latent image formation member;

attaching a second toner electrostatically to said electrostatic latent image formation member by generating a periodic AC electric field in which the time in which said electric field develops an electrostatic latent image with toner exceeds the time in which said electric field does not develop said electrostatic latent image with toner; and transferring said first and second toner held on said electrostatic latent image formation member simultaneously to a recording medium.

6. A color image recording method according to claim 5, further comprising the step of:

charging said second toner by mixing with magnetic carrier particles.

7. A color image recording method according to claim 6, further comprising the step of:

maintaining said electrostatic latent image formation member and said second toner not to contact each other.

8. A developing device for developing an electrostatic latent image comprising:

a developer holding member for holding toner;

a voltage applying means applying an AC voltage of a predetermined period to said developer holding member; and a voltage control means adjusting the voltage so that the time for the voltage to change from a value such that an electric field making toner move toward said electrostatic latent image is maximum to a value such that said electric field becomes minimum is at least ½ of said predetermined period.

* * * * *